US005203717A

United States Patent [19]

Beck et al.

[11] Patent Number: 5,203,717

[45] Date of Patent: Apr. 20, 1993

[54] COAX CONNECTOR ASSEMBLY

[75] Inventors: Herbert C. Beck, Simpsonville; Sam S. Shasteen, Greenville; Clifford L. DeYoung, Woodruff, all of S.C.

[73] Assignee: Woven Electronics Corporation, Greenville, S.C.

[21] Appl. No.: 873,342

[22] Filed: Apr. 21, 1992

Related U.S. Application Data

[63] Continuation of Ser. No. 706,161, May 28, 1991, abandoned.

[51] Int. Cl.[5] ..... H01R 13/58

[52] U.S. Cl. ..... 439/460; 439/427; 439/578

[58] Field of Search ..... 439/449–452, 439/457–460, 456, 586, 587, 578, 271, 274, 275, 427, 719

[56] References Cited

U.S. PATENT DOCUMENTS

| | | | |
|---|---|---|---|
| 3,434,137 | 3/1969 | Rueger | 439/460 |
| 4,281.887 | 8/1981 | Luca, Jr. | 439/449 |
| 4,364,621 | 12/1982 | Janvrin et al. | 439/595 |
| 4,601,530 | 7/1986 | Coldren et al. | 439/460 |
| 4,978,316 | 12/1990 | Yahata | 439/449 |

FOREIGN PATENT DOCUMENTS

| | | | |
|---|---|---|---|
| 0181703 | 4/1966 | U.S.S.R. | 439/458 |
| 0588877 | 6/1947 | United Kingdom | 439/457 |

*Primary Examiner*—David L. Pirlot

*Attorney, Agent, or Firm*—Cort Flint; Henry S. Jaudon

[57] ABSTRACT

A coax retention comb adapted to be fittingly engaged within an interior area of a back shell of a coax assembly. The comb includes a plurality of slots formed across its top and bottom surfaces, the slots are vertically offset from each other and are tapered inwardly from rear to front which are adapted to receive an insulated coaxial wire. The coaxial wire has a diameter slightly larger that the inward tapered end of the slots so that the tapered ends are expanded where the wires are inserted therein. The interior area of the back shell is of a size which forces the comb back into its original configuration when the comb is fitted therein. This causes the inwardly tapered ends of the slots to bite into the insulation of the wires which fixedly position the wires relative to the comb.

20 Claims, 4 Drawing Sheets

COAX CONNECTOR ASSEMBLY

This is a continuation of copening application Ser. No. 07/706,161 filed on May 28, 1991 now abandoned.

BACKGROUND OF THE INVENTION

This invention relates to a coax assembly and the method of arranging and positioning the individual wires within that assembly.

Wire separators have been used in automobiles to separate ignition wiring prior to 1950. These devices act to space rigid wiring materials. 3-M Corporation has used comb-like structures for separating and locating wire as an element of the tooling in their Displacement Connector product line. This product has been offered for sale since 1968.

Coax assemblies which include separators are well known throughout the art. U.S. Pat. Nos. 4,097,106 and 4,277,124 provide known arrangements in which the wires are locked into housings which are then connected to shrouds having terminals. These devices lack flexibility because the wires are locked into position prior to being positioned within the shroud. Other similar and more complex arrangements are shown in U.S. Pat. Nos. 3,737,883 and 4,767,355.

U.S. Pat. No. 4,601,530 shows an arrangement where a comb horizontally and vertically separates the wires for positioning into a housing. The comb along with the wires is moved into the housing part way. The comb then becomes stationary and the wires are pushed through the comb into passageways within the housing where they are secured. In this arrangement, it is the housing which separates and positions the wire ends.

It is an object of this invention to overcome the disadvantages of the prior art as discussed above.

It is a further object of this invention to provide a sturdy coax assembly.

It is a further object of this invention to provide a coax assembly which can easily and accurately be assembled.

It is an object of this invention to provide an inexpensive coax assembly.

It is an object of this invention to provide a comb for use with a coax assembly which acts to separate and hold positively the ends of a coax wire package.

SUMMARY OF THE INVENTION

A coax connector assembly consisting of a nonconductive housing which includes a multi-position connector and a back shell which may be permanently connected. The back shell has a hollow interior with a forward opening which receives a contact portion of the connector and a rearward opening through which insulated coax wires extend. A multi-wire retention comb is fittingly received within the hollow interior of the back shell. The comb comprises a plurality of offset slots arranged in at least two planes and are adapted to each receive one of the wires adjacent on end thereof. The comb acts to hold the wire ends in fixed relationship. The slots of the comb are tapered along their length so that when the wires are positioned within the slots and the comb is positioned within the back shell, an end portion of each of the slots bites into the insulation of the respective wire, and provides positive positioning thereof. The comb comprises a plurality of rows of slots which are arranged in different planes. The slots are vertically offset across the width of the comb. The comb comprises an upper surface, a lower surface, opposite side surfaces, a front surface and a rear surface. The slots are formed in the upper and lower surfaces and taper inwardly from the back surface toward the front surface. The hollow interior of the back shell is configurated and sized to receive the comb without frictional contact when the comb is not carrying the wires. When the slots are expanded at the tapered end when the wires are inserted therein, this causes the side surfaces to be forced outwardly so that when the wire filled comb is inserted into the hollow interior, the side walls must be forced back into their normal position. This causes the tapered ends to bite into the insulation and thereby positively position the wires. The coax wires may have a dielectric foam core. The wire insulation may comprise an extruded plastic such as PVC. A coax retention comb which is adapted to be fittingly engaged within an interior area of a back shell of a coax assembly and which includes a plurality of slots formed across its top and bottom surfaces, the slots are vertically offset from each other and are tapered inwardly from rear to front. The slots are adapted to receive an insulated coaxial wire which is of a diameter slightly larger that the inward tapered ends of the slots so that the tapered ends are expanded upon insertion of the coaxial wire. The interior area of the back shell is of a size to force the comb back into its original configuration when the comb is fitted into the interior area. This action causes the inwardly tapered ends of the slots to bite into the insulation of the coaxial wires which fixingly position the wires within the comb. The comb is made of plastic and is rectangular, its width is greater than its length and height. The slots are formed across the width to extend perpendicular thereto.

A coax assembly having a connector with a shaped rear surface from which a plurality of contacts extend. There is a shaped area adjacent the rear surface. The assembly includes a back shell having a multi-dimensioned hollow interior including a forward area adapted to fittingly receive the shaped area of the connector. A rearward area of less dimension than the forward area is provided and is adapted to receive a bundle of coaxial wires. Sandwiched between these areas is an intermediate area which is adapted to fittingly receive a retention comb.

The comb has a plurality of slots arranged across its width which fixingly engage an end of the wires when the comb is positioned within the back shell. The slots removably retain the wires when the comb is separated from the back shell. This allows the wires to be easily positioned within the slots during assembling of the assembly and to be positively positioned with the slots relative to the contacts when the coax assembly is assembled. The assembly may be permanently united when assembled.

The wires have a plastic insulation surrounding an elastic core.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
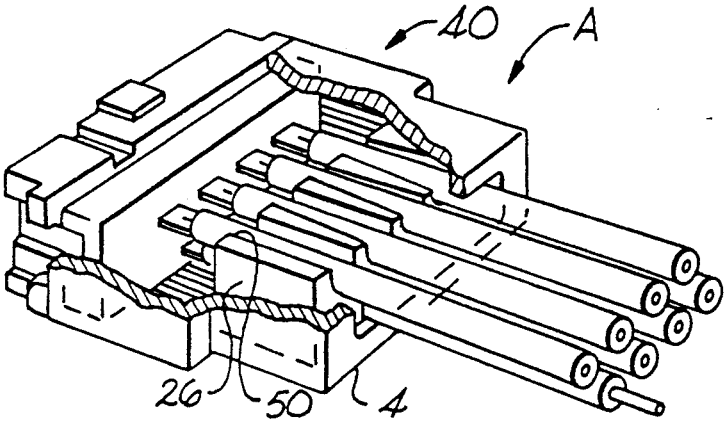
FIG. 1 is a perspective view of the coax assembly of the invention partially cut away.
Figure 2:
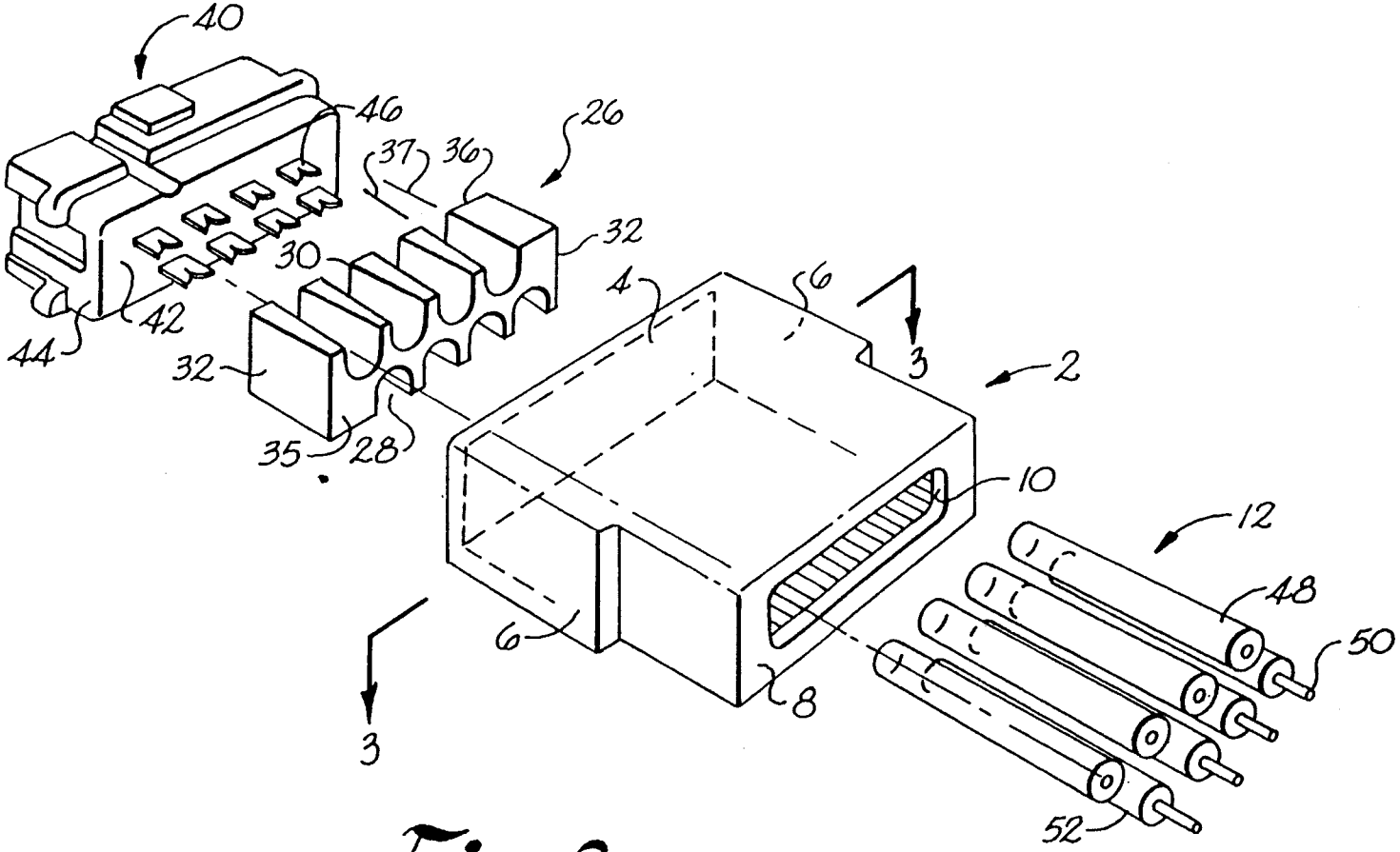
FIG. 2 is an exploded perspective view of the coax assembly.

FIGS. 1 and 2 show an electrical coax assembly A according to the invention. Assembly A includes a back shell 2 and a multi-position connector 40, both of which are preferably formed of plastic. Back shell 2, which has a hollow interior, is generally rectangular with top and bottom surfaces 4, side surfaces 6, and a rear wall 8. Rear wall 8 is provided with an opening 10 sized to receive a package of coax wires 12, usually consisting of between five and twenty wires.

Figure 3:
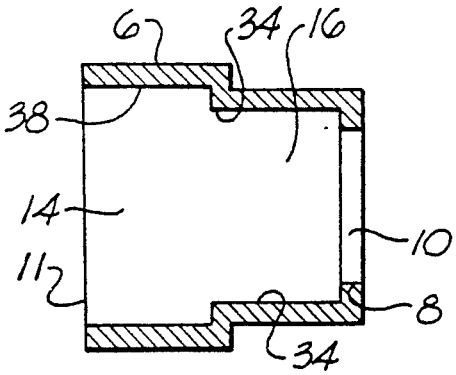
FIG. 3 is a sectional top view of the back shell.

The interior of back shell 2, best seen in FIG. 3, consist of a rectangular forward area 14 and a rectangular smaller rear area 16. The forward end 11 of back shell 2 is open so that retention comb 26 may be positioned within its hollow interior.

Figure 4:
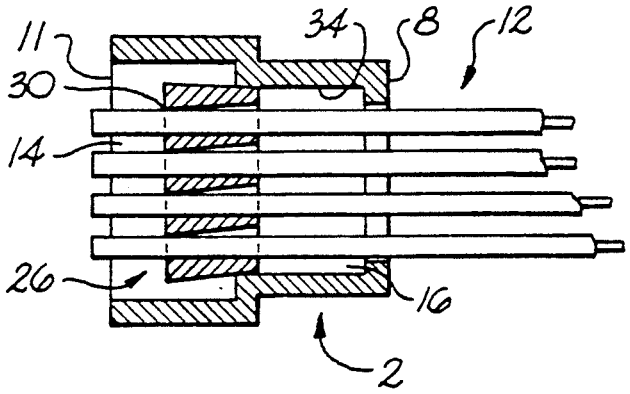
FIG. 4 is a sectional top view of the back shell with the retainer comb carrying coax wires partially in position in the shell.
Figure 6:
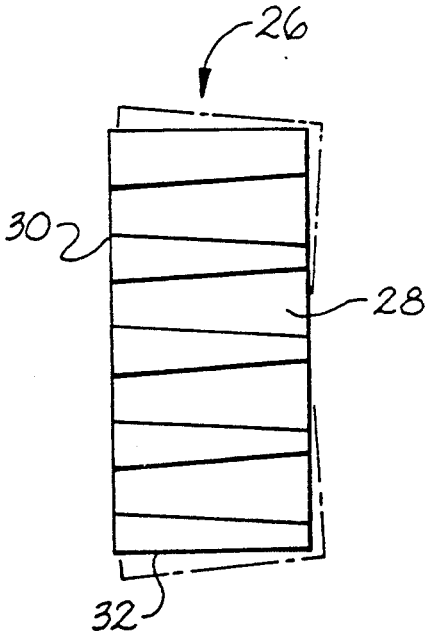
FIG. 6 is a top view of the comb showing in broken lines the expanded location of the side walls when the coax wires are inserted.

Comb 26, best seen in FIGS. 2, 4, and 6, includes a rectangular-shaped plastic member configured so that its side walls 32 fit easily, but snugly, between walls 34 of rear area 16 of back shell 4. The comb includes a plurality of slots 28 formed along its top and bottom surfaces and across its width. Slots 28 extend parallel with side surfaces 32 and are offset vertically across the width of comb 26. Slots 28 are generally U-shaped and are sized at the rear edges along face 35 of the comb to substantially conform with the size of the coax cables of coax 12. From face 35 toward face 36, slots 28 taper inwardly generally along lines 37 to form an inwardly protruding surface concluding with tapered end 30. A multi-position connector 40, which also is rectangular-shaped, is designed to fit into shell 2 and into area 14. Connector 40 includes, along its rear face 42, a protrusion 44 which is rectangularly shaped also but is of reduced size relative to the connector. Protrusion 44 is of equal size as forward opening 11 of shell 2 and is adapted to snugly fit against walls 38 of section 14 of the hollow interior. Rear surface 42 of connector 40 is provided with a plurality of individual contacts 46 which protrude rearwardly outwardly. Comb 26 is of a width and height substantially equal the width and height of the arrangement of contacts 46. This width and height is greater than the width and height of the package of coax cable package 12.

The coax package 12 consists of individual coaxial wires 48 arranged in packages of between five and twenty. There are eight wires shown in FIG. 2. Wires 48 consist of an extruded firm plastic insulation material 52 which is usually PVC. The insulation forming material could be any other suitable plastic. Insulation 52 surrounds core 50. Core 50 in this instance is a foam dielectric which has a very poor crushing strength and contains resilient properties. The invention is not intended to be limited to such type coax wires, and is equally applicable with non-resilient core wires.

In practice, the end of package 12 is inserted through opening 10 of shell 2. Wires 48 are laterally and vertically separated as they are individually placed in slots 28. The ends of wires 48 are arranged equal distance from front face 36 of comb 26. This is easily accomplished because, at this point, wires 48 are not securely held by slots 28. Because the slots are tapered inwardly to a minimum size at edge 30, wires 48 gradually expand slots 28 toward the tapered end in a widthwise direction. This is best seen in FIG. 4. The final result is that sides 32 are forced outwardly in a wedge-shaped manner as shown in broken lines in FIG. 6.

Figure 5:
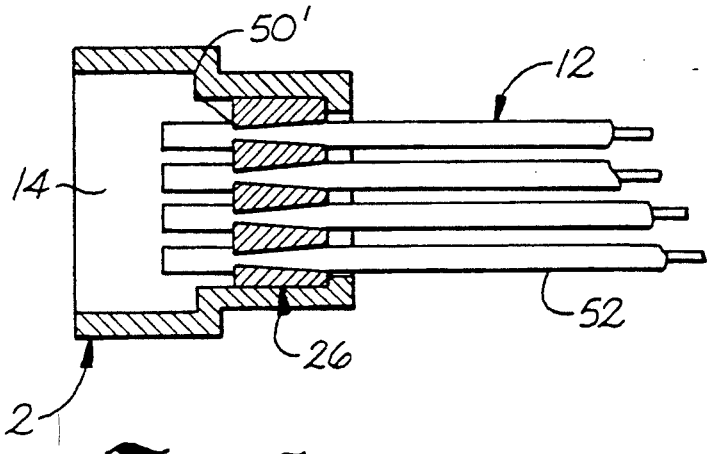
FIG. 5 is a sectional top view showing the comb carrying coax wires in position in the shell.

Comb 26 carrying coax package 12 is now slipped into area 16 of shell 2. As comb 26 is moved toward rear wall 8, side walls 34 of shell 2 force sides 32 of the comb back into their original positions. This action causes tapered edges 30 to bite into insulation 52 of wires 48 and to form an indentation therein as shown at 50' in FIGS. 1 and 5. This action securely and firmly holds wires 48 in position with the forward ends of the coax package in position as shown in FIGS. 1 and 5.

Protrusion 44 of multi-connector 40 is now positioned through opening 11 into open area 14 and contacts 46 are brought into engagement with the ends of wires 48. Normally, multi-connector 40 is glued in position with shell 2 forming a unitary coax assembly. It is acceptable to apply glue to both comb 26 and coax assembly 12 when assembling so that when positioned they too become a unitary assembly. This is not necessary because the biting action of tapered edges 30 into insulation 52 is sufficient to securely hold coax wires 48 in position. The resilient action of wires 48 against edges 30 which subsequently is registered against walls 34 by sides 32 provides sufficient force to maintain comb 26 in a fixed position.

While a preferred embodiment of the invention has been described using specific terms, such description is for illustrative purposes only, and it is to be understood that changes and variations may be made without departing from the spirit or scope of the following claims.

What is claimed is:

1. A connector assembly comprising:

a non-conductive housing which includes a multi-position connector and a back shell;

said back shell having a hollow interior with a forward opening which receives a contact portion of said connector and a rearward opening through which insulated wires extend;

a multi-wire retention comb having a plurality of slots fittingly received within said hollow interior, said slots are adapted to each receive one of said wires substantially adjacent an end thereof and to hold said wire ends in fixed relationship;

said slots are tapered inwardly longitudinally along their length from a first end toward a second end to form an inwardly tapered and protruding portion so that when said wires are positioned within said slots to extend substantially longitudinally thereof and said comb is positioned within said back shell, said protruding portion of each of said slots bites into said insulation of said respective wire to provide positive retention of said wires in said fixed relationship.

2. The connector assembly of claim 1 wherein said connector and said back shell are permanently connected.

3. The connector assembly of claim 1 wherein said comb comprises a plurality of horizontal rows of said slots arranged along different vertical planes.

4. The connector assembly of claim 3 wherein said slots are vertically offset across the width of said comb.

5. The connector assembly of claim 1 wherein said comb comprises an upper surface, a lower surface, opposite side surfaces, a front surface and a rear surface, said slots are formed in said upper and lower surfaces and taper inwardly from said back surface toward said front surface.

6. The connector assembly of claim 5 wherein said hollow interior is configurated and sized to receive said comb with minimum frictional contact when said comb is absent said wires.

7. The connector assembly of claim 6 wherein said slots are expanded by said wires at said tapered end when said wires are inserted therein so that said side surfaces are forced outwardly whereby when said wire filled comb is inserted in said hollow interior, said side surfaces are forced inwardly back into their normal position thereby causing said tapered ends to bite into said insulation.

8. The connector assembly of claim 1 wherein said wires comprise dielectric foam core.

9. The connector assembly of claim 8 wherein said insulation comprises an extruded plastic.

10. The connector assembly of claim 9 wherein said plastic is PVC.

11. A retention comb adapted to be fittingly engaged within an interior area of a back shell of a connector assembly:

said comb includes a front and a rear surface and top and bottom surfaces, a plurality of slots are formed across at least one of said top and bottom surfaces, said slots are tapered inwardly from said rear towards said front surface to define an inwardly projecting portion;

said slots are adapted to receive an insulated wire, said wire having a diameter slightly larger than the inward tapered portion of said slots so that said comb is expanded from an original configuration upon insertion of said wire; and said interior area of said back shell is of a size to force said comb into substantially said original configuration when said comb is fitted into said interior area; whereby said inwardly tapered portions of said slots bite into said insulation so as to fixingly position and retain said wires within said comb.

12. The retention comb of claim 11 wherein said comb is rectangular, its width is greater than its length and height; and said slots are formed across the width of said comb to extend perpendicular thereto.

13. The retention comb of claim 11 wherein said comb and said back shell are plastic.

14. The coax assembly of claim 11 wherein said assembly is permanently united.

15. The retention comb of claim 11 wherein each of said slots are formed across both said top and bottom surfaces and area vertically offset from each other.

16. A assembly comprising:

a connector having a shaped rear surface from which a plurality of contacts extend, said connector including a shaped area adjacent said rear surface;

a back shell having a multi-dimensioned hollow interior, said interior including a forward area adapted to fittingly receive said shaped area of said connector, a rearward area of less dimension than said forward area which is adapted to receive a bundle of wires and an intermediate area adapted to fittingly receive a retention comb;

said retention comb having a plurality of slots in substantial coaxial longitudinal relationship, each adapted to receive one of said wires, each said slot being inwardly tapered substantially along its longitudinal axis from first of its ends toward a second of its ends so that said wires are fixedly engaged within said slots by substantially only said first of said ends when said comb is positioned within said back shell and are removably engaged within said slots when said comb is separated from said back shell; whereby said wires are easily positioned within said slots during forming of said assembly and are positively positioned within said slots relative to said contacts upon completion of said assembly.

17. The coax assembly of claim 16 wherein said assembly is plastic.

18. The coax assembly of claim 16 wherein there are a plurality of horizontal rows of slots which are vertically spaced and offset.

19. The coax assembly of claim 16 wherein said wires have a plastic insulation surrounding an elastic core.

20. The coax assembly of claim 16 wherein said comb acts to spread said wires so as to align the ends thereof with said contacts of said connector.

* * * * *